US007599833B2

(12) United States Patent
Sung et al.

(10) Patent No.: US 7,599,833 B2
(45) Date of Patent: Oct. 6, 2009

(54) APPARATUS AND METHOD FOR CODING RESIDUAL SIGNALS OF AUDIO SIGNALS INTO A FREQUENCY DOMAIN AND APPARATUS AND METHOD FOR DECODING THE SAME

(75) Inventors: Jong-Mo Sung, Daejon (KR); Hyun-Woo Kim, Seoul (KR); Mi-Suk Lee, Daejon (KR); Do-Young Kim, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 504 days.

(21) Appl. No.: 11/441,955

(22) Filed: May 26, 2006

(65) Prior Publication Data

US 2006/0277040 A1 Dec. 7, 2006

(30) Foreign Application Priority Data

May 30, 2005 (KR) ..... 10-2005-0045752
May 11, 2006 (KR) ..... 10-2006-0042645

(51) Int. Cl.
*G10L 19/00* (2006.01)
*G10L 19/12* (2006.01)

(52) U.S. Cl. ..... 704/219; 704/221

(58) Field of Classification Search ..... 704/219, 704/221–223

See application file for complete search history.

(56) References Cited

U.S. PATENT DOCUMENTS 6,081,776 A * 6/2000 Grabb et al. ..... 704/219
6,456,964 B2 * 9/2002 Manjunath et al. ..... 704/205
6,493,664 B1 * 12/2002 Udaya Bhaskar et al. ... 704/222
6,687,668 B2 * 2/2004 Kim et al. ..... 704/223
6,691,082 B1 * 2/2004 Aguilar et al. ..... 704/219
6,691,084 B2 * 2/2004 Manjunath et al. ..... 704/221
6,691,092 B1 * 2/2004 Udaya Bhaskar et al. ... 704/265

(Continued)

FOREIGN PATENT DOCUMENTS

JP 10-020892 1/1998

(Continued)

OTHER PUBLICATIONS

Erdmann, et al. (2002) "Embedded Speech Coding Based on Pyramid Celp." IEEE. pp. 29-31.

*Primary Examiner*—Michael N Opsasnick
(74) *Attorney, Agent, or Firm*—Ladas & Parry LLP

(57) ABSTRACT

Provided is a residual signal coding/decoding apparatus and method. The residual signal coding apparatus includes a transformer, an LPC coefficient extractor, an LPC coefficient quantizer, an LP analysis filter, a band splitter, a pulse searcher, and a pulse quantizer. The transformer transforms time-domain residual signals into a frequency domain to output transform coefficients. The LPC coefficient extractor extracts LPC coefficients from the transform coefficients. The LPC coefficient quantizer quantizes the LPC coefficients to output quantized LPC coefficients and corresponding indices. The LP analysis filter performs an LP analysis on the transform coefficients to output LP residual transform coefficients. The band splitter splits the LP residual transform coefficients into bands to output the LP residual transform coefficients. The pulse searcher searches the LP residual transform coefficients for the respective bands to select optimal pulses and output parameters of the optimal pulses. The pulse quantizer quantizes the parameters of the optimal pulses.

26 Claims, 7 Drawing Sheets

U.S. PATENT DOCUMENTS

| | | | | |
|---|---|---|---|---|
| 7,222,070 | B1 * | 5/2007 | Stachurski et al. | 704/207 |
| 2001/0044717 | A1 * | 11/2001 | Ferhaoui et al. | 704/223 |
| 2003/0177004 | A1 * | 9/2003 | Jabri et al. | 704/219 |
| 2005/0137858 | A1 * | 6/2005 | Heikkinen et al. | 704/205 |

FOREIGN PATENT DOCUMENTS

| | | |
|---|---|---|
| KR | 1020000074088 | 5/2000 |
| KR | 1020040080726 | 9/2004 |
| KR | 10-2005-0004596 | 1/2005 |
| KR | 10-2005-0006883 | 1/2005 |

* cited by examiner

APPARATUS AND METHOD FOR CODING RESIDUAL SIGNALS OF AUDIO SIGNALS INTO A FREQUENCY DOMAIN AND APPARATUS AND METHOD FOR DECODING THE SAME

FIELD OF THE INVENTION

The present invention relates to an audio coding/decoding technology; and, more particularly, to a residual signal coding apparatus and method for converting residual signals of audio signals into a frequency domain to output residual parameters, and a residual signal decoding apparatus and method for restoring residual signals from the residual parameter.

DESCRIPTION OF THE PRIOR ART

Technologies for digitizing and transmitting audio signals are widely used in a wired and wireless communication network including a telephone network, a mobile communication network, and a Voice over Internet Protocol (VoIP) network that recently is more attractive. When it is assumed that a signal is sampled at 8 KHz and each sample is coded with 8 bits, a data rate of about 64 Kbps is required. However, when an audio signal is transmitted using a voice analysis technique and a proper coding technique, a data rate can be reduced considerably.

An example of such an audio compression scheme is a transform coding scheme. In the transform coding scheme, after a time-domain audio signal is transformed into a frequency domain, coefficients corresponding to respective frequency components are quantized and coded. When the respective frequency components are coded using the auditory characteristics of humans, the transform coding scheme can reduce a data rate.

Recently, an audio coding scheme advances from a narrowband audio coding scheme corresponding to the telephone network to the wideband audio coding scheme that can provide better naturalness and intelligibility. Also, a multi-rate coder, which supports various data rates using a unified audio coding method, is widely used to accommodate a variety of network environments.

With these trends, an embedded variable rate coder is being developed to support bandwidth scalability and bit-rate scalability. The embedded variable rate coder is configured such that a bit stream of higher bit-rate contains a bit stream of lower bit-rate. To this end, the embedded variable bit-rate coder usually adopts a residual signal coding scheme.

FIG. 1 is a block diagram of a conventional audio coding/decoding apparatus using a residual signal coding method.

A conventional audio coding apparatus 100 includes a core coder 101, a core decoder 103, a residual signal generator 105, a residual coder 107, and a parameter packer 109. The core coder 101 codes input audio signals to output core parameters. The core decoder 103 decodes the core parameters from the core coder 101 to output core signals. The residual signal generator 105 subtracts the core signals of the core decoder 103 from the input audio signals to output residual signals. The residual coder 107 codes the residual signals from the residual signal generator 105 to output residual parameters. The parameter packer 109 converts the core parameters from the core coder 101 and the residual parameters from the residual coder 107 into a bit stream in predetermined manner.

A conventional audio decoding apparatus 110 includes a core decoder 111, an audio signal decoder 113, a residual decoder 115, and a parameter unpacker 117. The parameter unpacker 117 receives the bit stream from the audio coding apparatus 100 and converts the bit stream into core parameters and residual parameters. The core decoder 111 decodes the core parameters to output core signals. The residual decoder 115 decodes the residual parameters to output residual signals. The audio signal decoder 113 adds the core signals from the core decoder 111 and the residual signals from the residual decoder 115 to output decoded audio signals.

FIG. 2 is a detailed block diagram of a conventional residual signal coder/decoder, which codes/decodes residual signals using a transform coding scheme.

The residual coder 107 includes a transformer 201, a transform coefficient normalizer 203, a scale factor quantizer 205, a scale factor calculator 207, and a normalized transform coefficient (NTC) quantizer 209.

The transformer 201 receives a time-domain residual signal and transforms the time-domain residual signal into a frequency domain transform coefficients. The transform may be performed using an MDCT (modified discrete cosine transform) scheme, but the present invention is not limited to this. The scale factor calculator 207 receives the transform coefficients from the transformer 201 to calculate and output a scale factor. Here, the scale factor is a normalized energy that is obtained by dividing the total energy of the transform coefficients by the number of the transform coefficients.

The scale factor quantizer 205 quantizes the scale factor from the scale factor calculator 207 to output a quantized scale factor. The quantized scale factor is input to the transform coefficients normalizer 203 and the residual decoder 115. The transform coefficient normalizer 203 divides the transform coefficients from the transformer 201 by the quantized scale factor from the scale factor quantizer 205 to output normalized transform coefficients (NTCs). The NTC quantizer 209 quantizes the NTCs from the transform coefficient normalizer 203 to output quantized NTCs to the residual decoder 115. Accordingly, the residual coder 107 outputs the residual parameters including the quantized scale factor and the quantized transform coefficients.

The residual decoder 115 includes an NTC de-quantizer 211, a transform coefficient de-normalizer 213, a scale factor de-quantizer 215, and an inverse-transformer 217.

The NTC de-quantizer 211 de-quantizes the quantized NTCs from the NTC quantizer 209 to output restored NTCs. The scale factor de-quantizer 215 de-quantizes the quantized scale factor from the scale factor quantizer 205 to output a restored scale factor. The transform coefficient de-normalizer 213 multiplies the restored NTCs from the NTC de-normalizer 211 by the restored scale factor from the scale factor de-quantizer 215 to output restored transform coefficients. The inverse-transformer 217 inverse-transforms the restored transform coefficients from the transform coefficient de-normalizer 213 to output decoded time-domain residual signals. The inverse-transform operation may be performed using an IMDCT (inverse MDCT) scheme corresponding to an MDCT scheme.

However, in the conventional residual signal coding method using the transform coding scheme, harmonic components of the decoded audio signals are distorted by quantization noise, thereby degrading an audio quality. Also, because the conventional residual signal coding method processes all transform coefficients, it requires a large memory requirement and a large amount of computational complexity.

SUMMARY OF THE INVENTION

It is, therefore, an object of the present invention to provide a residual signal coding/decoding apparatus and method that employs a linear predictive coding model and a track structure in a transform coding scheme, thereby enhancing an audio quality, saving a memory requirement, and reducing the amount of computational complexity.

In accordance with an aspect of the present invention, there is provided a residual signal coding apparatus including: a transformer transforming time-domain residual signals into a frequency domain to output transform coefficients; a linear predictive coding (LPC) coefficient extractor extracting LPC coefficients from the transform coefficients; an LPC coefficient quantizer quantizing the LPC coefficients to output quantized LPC coefficients and corresponding indices; a linear prediction (LP) analysis filter including a filter made of the quantized LPC coefficients and performing an LP analysis on the transform coefficients to output LP residual transform coefficients; a band splitter splitting the LP residual transform coefficients into a predetermined number of bands to output the LP residual transform coefficients on a per-band basis; a pulse searcher searching the LP residual transform coefficients for the respective bands to select an optimal pulse and output parameters of the optimal pulse; and a pulse quantizer quantizing the parameters of the optimal pulse.

In accordance with another aspect of the present invention, there is provided a residual signal coding method including the steps of: transforming time-domain residual signals into a frequency domain to output transform coefficients; extracting linear predictive coding (LPC) coefficients from the transform coefficients; quantizing the LPC coefficients to output quantized LPC coefficients and corresponding indices; performing, using a filter made of the quantized LPC coefficients, a linear prediction (LP) analysis on the transform coefficients to output LP residual transform coefficients; splitting the LP residual transform coefficients into a predetermined number of bands to output the LP residual transform coefficients on a per-band basis; searching the LP residual transform coefficients for the respective bands to select an optimal pulse and output parameters of the optimal pulse; and quantizing the parameters of the optimal pulse.

In accordance with yet another aspect of the present invention, there is provided a residual signal decoding apparatus including: a linear predictive coding (LPC) de-quantizer de-quantizing indices of quantized LPC coefficients to output restored LPC coefficients; a pulse de-quantizer de-quantizing quantized pulse parameters to output restored pulse parameters; a pulse generator generating pulses from the restored pulse parameters to output restored linear prediction (LP) residual transform coefficients for respective bands; a band combiner concatenating the restored LP residual transform coefficients for the respective bands with respect to all the bands to output restored LPC residual transform coefficients; an LP synthesis filter including a filter made of the restored LPC coefficients and performing an LP synthesis on the restored LP residual transform coefficients to output restored transform coefficients; and an inverse-transformer inverse-transforming the restored frequency-domain transform coefficients into a time domain to decode residual signals.

In accordance with still another aspect of the present invention, there is provided a residual signal decoding apparatus including: a linear predictive coding (LPC) de-quantizer de-quantizing indices of quantized LPC coefficients to output restored LPC coefficients; a pulse de-quantizer de-quantizing quantized pulse parameters to output restored pulse parameters; a pulse generator generating pulses from the restored pulse parameters to output restored linear prediction (LP) residual transform coefficients for respective bands; a band combiner concatenating the restored LP residual transform coefficients for the respective bands with respect to all the bands to output restored LPC residual transform coefficients; an LP synthesis filter including a filter made of the restored LPC coefficients and performing an LP synthesis on the restored LP residual transform coefficients to output restored transform coefficients; and an inverse-transformer inverse-transforming the restored frequency-domain transform coefficients into a time domain to decode residual signals.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Detailed descriptions about well-known functions or structures will be omitted if they are deemed to obscure the subject matter of the present invention.

Figure 3:
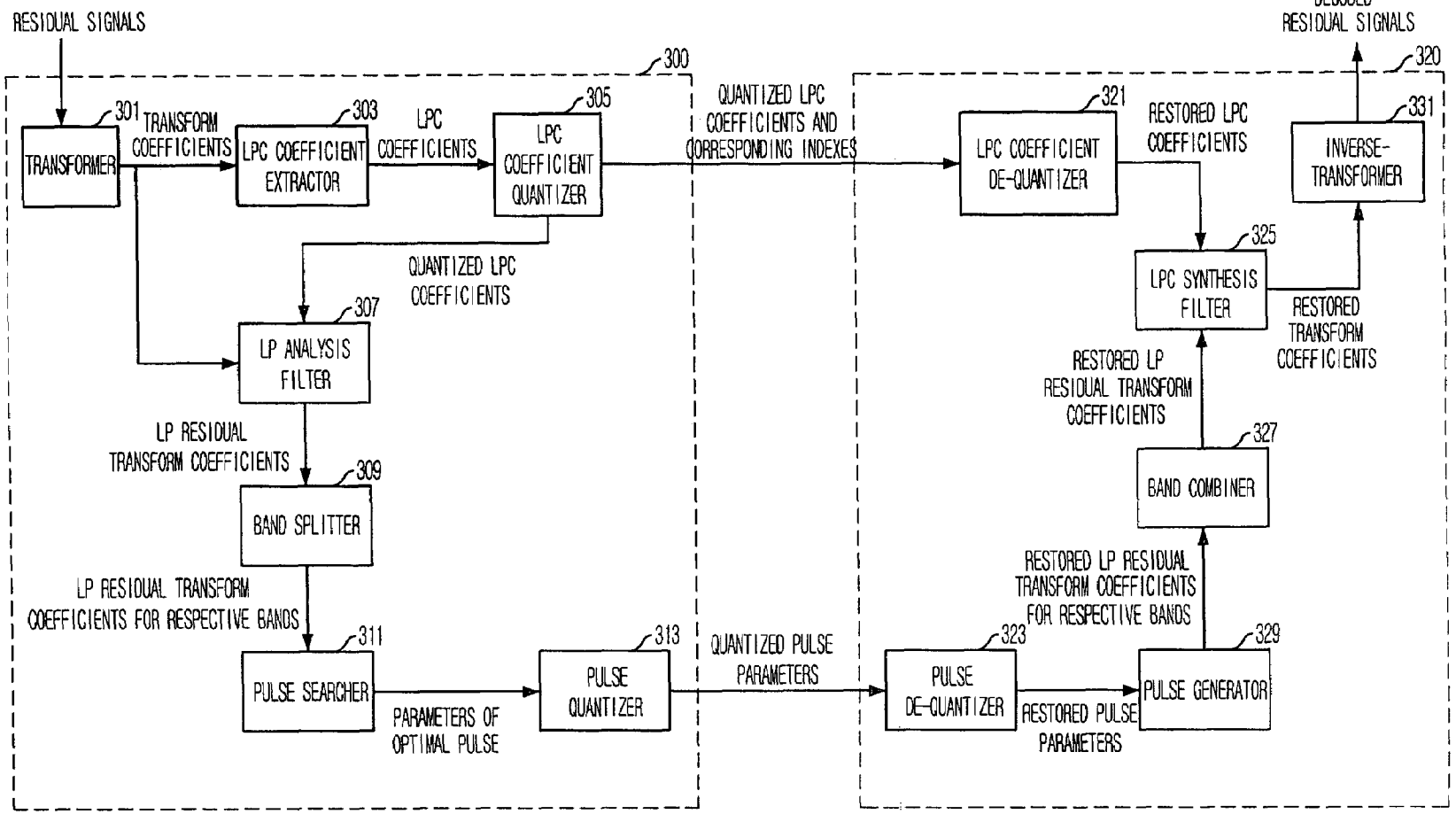
FIG. 3 is a block diagram of a residual signal coding/decoding apparatus for coding/decoding a residual signal using a transform coding scheme in accordance with an embodiment of the present invention.

FIG. 3 is a block diagram of a residual signal coding/decoding apparatus for coding/decoding a residual signal using a transform coding scheme in accordance with an embodiment of the present invention.

Figure 1:
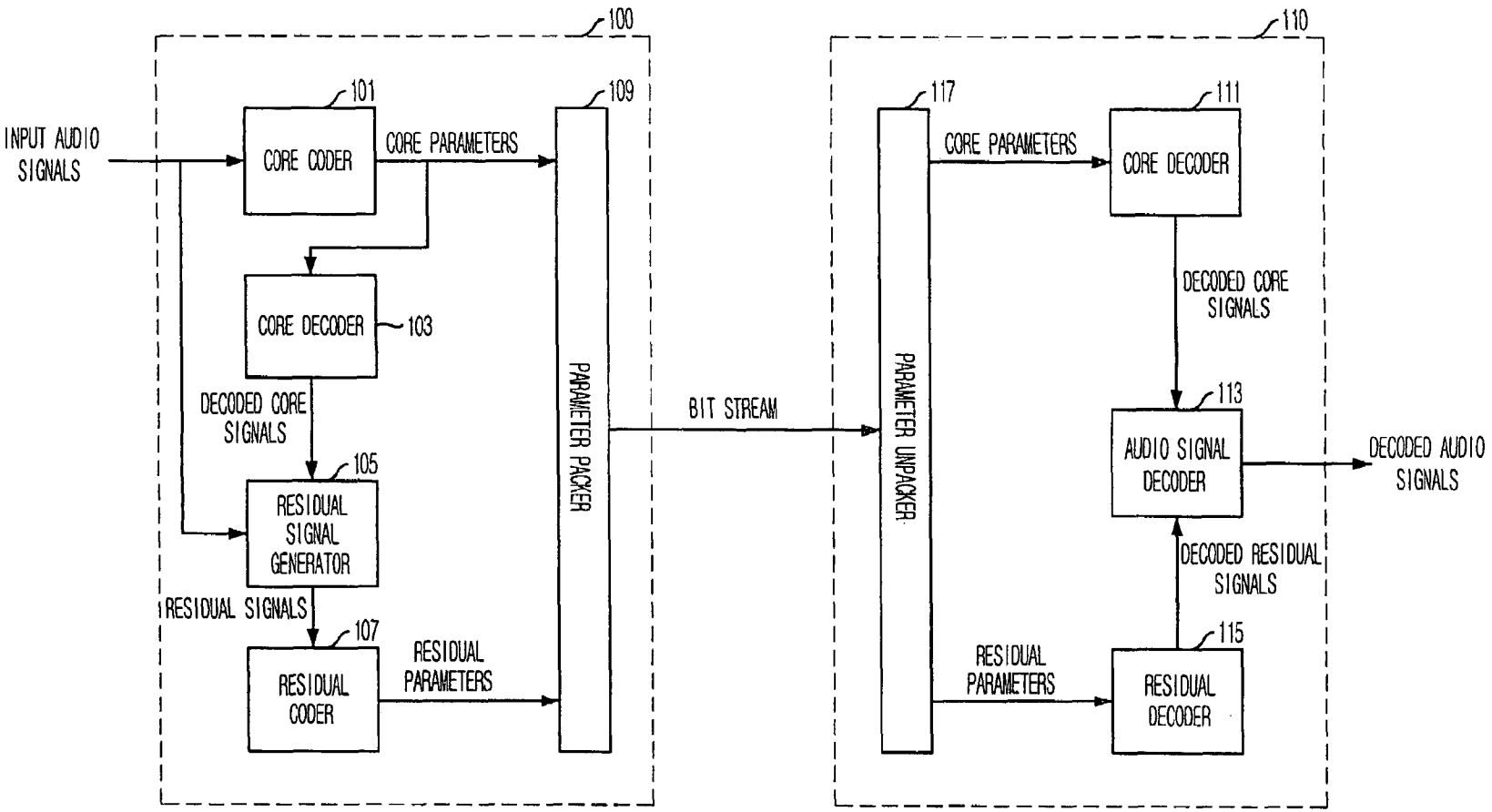
FIG. 1 is a block diagram of a conventional audio coding/decoding apparatus using a residual signal coding method.
Figure 2:
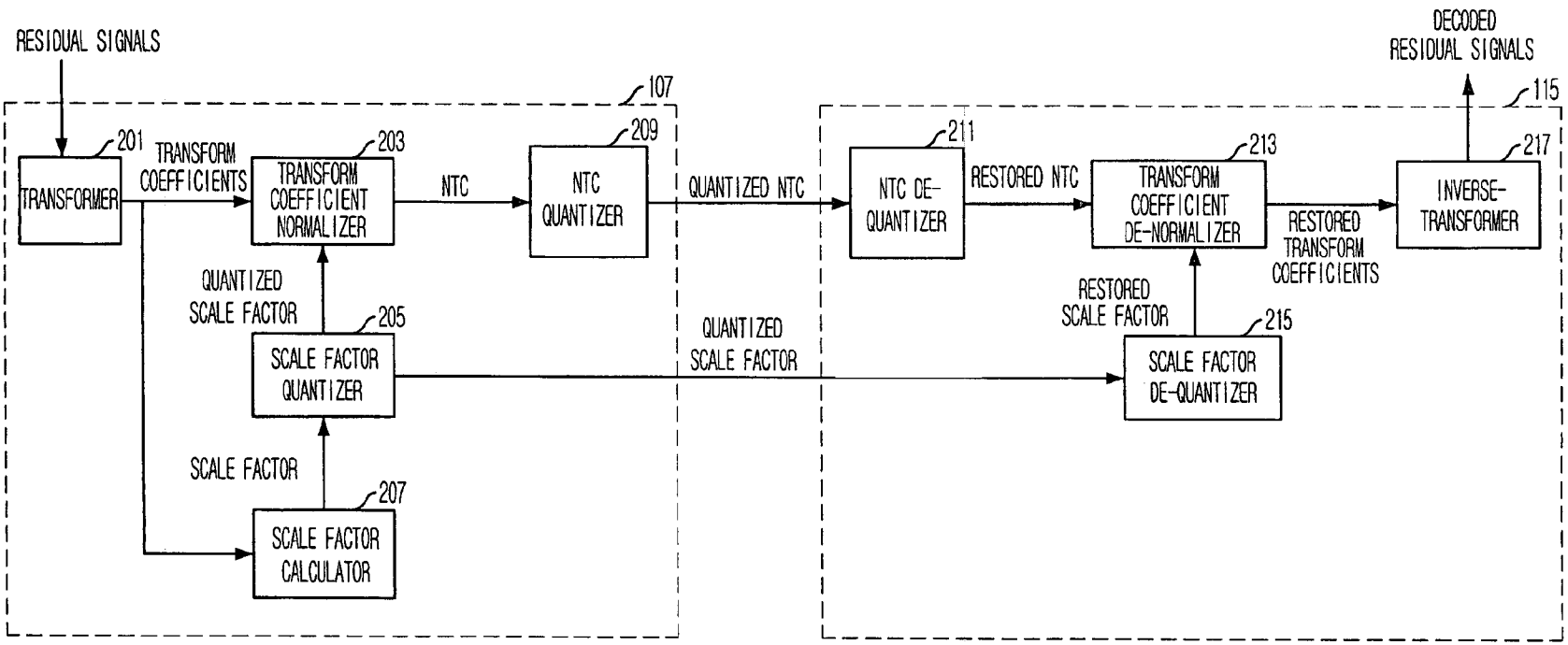
FIG. 2 is a detailed block diagram of a conventional residual signal coder/decoder.

The residual signal coding/decoding apparatus according to the present invention can be applied to the audio coding/decoding apparatus using the residual signal coding method of FIG. 1.

A residual signal coding apparatus 300 includes a transformer 301, a linear predictive coding (LPC) coefficient extractor 303, an LPC coefficient quantizer 305, a linear prediction (LP) analysis filter 307, a band splitter 309, a pulse searcher 311, and a pulse quantizer 313.

The transformer 301 transforms time-domain residual signals, which are outputted from, for example, the residual signal generator 105, into a frequency domain to output transform coefficients. In one embodiment, transformed Modified Discrete Cosine Transform (MDCT) coefficients X(k) are calculated by performing an MDCT on the time-domain residual signals using Equation 1 below. However, the frequency domain transform method of the present invention is not limited to an MDCT. That is, it will be apparent to those skilled in the art that a variety of frequency domain transform methods may be used without departing from the sprit and scope of the present invention.

$$X(k) = \sum_{n=0}^{N-1} x(n)h(n)\cos\left\{\frac{2\pi}{N}\left(k+\frac{1}{2}\right)\left(n+\frac{N}{4}+\frac{1}{2}\right)\right\} \quad \text{Eq. (1)}$$

$$k = 0, 1, \ldots, \frac{N}{2}-1, n = 0, 1, \ldots, N-1$$

where X(k) represents the MDCT coefficients, x(n) represents the time-domain residual signals, h(n) represents a window function, n represents time-domain sample indices, and N represents the size of an MDCT block.

The LPC coefficient extractor 303 extracts LPC coefficients from the transform coefficients X(k) outputted from the transformer 301. The LPC coefficients are p number of coefficients that minimize a value of a function E, which represents a squared prediction error over transform block N between a current transform coefficient and predicted coefficient from the linear combination of past p number of transform coefficients, with respect to all the transform coefficients k (k=0, 1, . . . , N−1). That is, the LPC coefficients are coefficients $\{a_i\}$ that minimizes E of Equation 2 below.

$$E = \sum_{k=0}^{N-1}\left\{X(k) - \sum_{i=1}^{p} a_i X(k-i)\right\}^2 \quad \text{Eq. (2)}$$

where p represents an LP order.

The LPC coefficients may be calculated using the well-known Levinson-Durbin algorithm to solve autocorrelation method, but the present invention is not limited to this. That is, it will be apparent to those skilled in the art that a variety of LPC coefficients calculation methods may be used without departing from the sprit and scope of the present invention.

The LPC coefficient quantizer 305 quantizes the LPC coefficients from the LPC coefficient extractor 303 to output quantized LPC coefficients and corresponding indices. A variety of quantization schemes, such as a vector quantization (VQ) scheme or a predictive split vector quantization (PSVQ) scheme, may be used to quantize the LPC coefficients. The indices of the quantized LPC coefficients are input to a residual signal decoding apparatus 320. The quantized LPC coefficients are used to make the LP analysis filter 307.

The LP analysis filter 307 is a filter that is made of the quantized LPC coefficients from the LPC coefficient quantizer 305. The LP analysis filter 307 performs an LP analysis on the transform coefficients from the transformer 301 to output LP residual transform coefficients. That is, the LP analysis filter 307 calculates LP residual transform coefficient R(k) according to Equation 3 below.

$$R(k) = X(k) - \sum_{i=1}^{p} a_i' X(k-i) \quad \text{Eq. (3)}$$

where $\{a'_i\}$ represents the quantized LPC coefficients.

In order to split the entire band of the LP residual transform coefficients into a predetermined number of bands, the band splitter 309 splits the LP residual transform coefficients from the LP analysis filter 307 on a per-band basis to output the LP residual transform coefficients for the respective bands. The band splitting operation may be performed using a variety of band split methods, such as a method of splitting bands at a constant interval and a method of splitting bands using a critical band reflecting the auditory characteristics of a human ear.

The pulse searcher 311 searches the LP residual transform coefficients for the respective bands, which are outputted from the band splitter 309, to select an optimal coefficient. At this point, when each of the LP residual transform coefficients is regarded as one pulse, the respective pulses can be represented by their signs, positions and magnitude. Accordingly, when an optimal pulse is selected by searching the LP residual transform coefficients (pulses), pulse parameters including the sign, position and magnitude information of the selected optimal pulse are outputted.

When all the LP residual transform coefficients of each band are searched in the codebook which is usually trained at a prior and consists of many codewords, a large memory usage and a large amount of computation are required due to the large search range. However, in an embodiment of the present invention, the pulse searcher 311 again splits the LP residual transform coefficients of each band, which outputted from the band splitter 309, into a predetermined number of tracks and searches each tracks for an optimal pulse, thereby saving a memory usage and reducing the amount of computation.

In an embodiment of the present invention, when the number of the LP residual transform coefficients in a given band is 40 and the number of the pulses to be searched is 5, a track structure as illustrated in Table 1 below is used for the coefficient selecting operation.

TABLE 1

| Pulse | Sign | Position |
|---|---|---|
| $i_0$ | $s_0$: ±1 | 0, 5, 10, 15, 20, 25, 30, 35 |
| $i_1$ | $s_1$: ±1 | 1, 6, 11, 16, 21, 26, 31, 36 |
| $i_2$ | $s_2$: ±1 | 2, 7, 12, 17, 22, 27, 32, 37 |
| $i_3$ | $s_3$: ±1 | 3, 8, 13, 18, 23, 28, 33, 38 |
| $i_4$ | $s_4$: ±1 | 4, 9, 14, 19, 24, 29, 34, 39 |

As illustrated in Table 1, the number of tracks splitting LP residual transform coefficients (pulses) of a given band is 5 and the number of pulses per track is 8 (i.e., 8 positions). In the given band, the number of pulses to be searched is 5 and one pulse is selected from each track as an optimal pulse. At this point, the pulse selected from each track is referred to as "a per-track selected pulse." In the track structure, sign information q1 and position information in each track are illustrated (In Table 1, 0, 5, 10, 15, 20, 25, 30, 35 for the first track). A separate codebook is required to represent the magnitude information of each pulse in each track. In an embodiment illustrated in Table 1, the sign and position information of each pulse are quantized by the pulse quantizer 313 with a predetermined number of bits (1 bit for plus/minus sign information, and 3 bits for position information), and the magnitude information may be quantized with a predetermined number of bits according to the separate codebook.

Also, when the number of LP residual transform coefficients in another given band is 40 and the number of pulses to be searched is 9, a track structure as illustrated in Table 2 below is used for the coefficient selecting operation.

TABLE 2

| Pulse | Sign | Position |
|---|---|---|
| $i_0, i_1, i_2$ | $s_0, s_1, s_2$: ±1 | 0, 1, 2, 3, 4, 5, 6, 7, 8, 9, 10, 11, 11, 12, 13, 14, 15 |
| $i_3, i_4$ | $s_3, s_4$: ±1 | 16, 17, 18, 19, 20, 21, 22, 23 |
| $i_5, i_6$ | $s_5, s_6$: ±1 | 24, 25, 26, 27, 28, 29, 30, 31 |
| $i_7$ | $s_7$: ±1 | 32, 33, 34, 35 |
| $i_8$ | $s_8$: ±1 | 36, 37, 38, 39 |

As illustrated in Table 2, the number of tracks splitting LP residual transform coefficients (pulses) of a given band is 5 and the number of pulses per track is 16, 8, 8, 4, and 4, respectively. In the given band, the total number of pulses to be searched is 9 and the numbers of pulses to be selected from the respective tracks as optimal pulses are 3, 2, 2, 1, and 1, respectively. At this point, the pulses selected from each track are referred to as "per-track selected pulses," and the group of the per-track selected pulses is referred to as "a per-track selected pulse combination." That is, in an embodiment illustrated in Table 2, if pulses with positions of 0, 1 and 2 in the first track are selected as optimal pulses, the pulse with a position of 0, the pulse with a position of 1 and the pulse with a position of 2 are per-track selected pulses. Also, the pulse with a position of 0, the pulse with a position of 1, and the pulse with a position of 2 (i.e., the group of per-track selected pulses in the first track) are referred to as "a per-track pulse combination." As described above, in the embodiment illustrated in Table 2, the sign information of each pulse may be quantized by the pulse quantizer 313 with one bit. Also, the position information of the respective pulses selected from the first track may be quantized with 4 bits, i.e., 16 positions, the position information of the respective pulses in the second and third tracks may be quantized with 3 bits, i.e., 8 positions, and the position information of the respective pulses in the fourth and fifth tracks may be quantized with 2 bits, i.e., 4 positions. As described above, the magnitude information of each pulse may be quantized with a predetermined number of bits according to the separate codebook.

In addition to the above track structures, a variety of other track structures may be used considering the number D of LP residual transform coefficients for each band and the number G of pulses to be searched in each band. That is, the number T of tracks, the number $2^m$ (m: natural number; and $$\underset{@T}{Q} g = G\Big)$$

to be searched in each track, and the number g (g: natural number; and $$\underset{@T}{Q} 2^m = D\Big)$$

may be determined in various ways to split the LP residual transform coefficients for each band into tracks.

Using the above track structures, the pulse searcher 360 may search the pulses by an open-loop scheme or a closed-loop scheme. In the open-loop scheme, the LP residual transform coefficients are searched in each track to select optimal pulses in descending order of a pulse magnitude (See FIG. 4). The closed-loop scheme also known as analysis-by-synthesis method selects a pulse that minimizes a difference, i.e., an error value, between the original transform coefficient from the transformer 301 and the transform coefficient that is LP-combined by a local decider (not illustrated) of the residual signal coding apparatus 300 in consideration of all combinations with the respective pulse positions in the respective tracks (See FIG. 5). It will be apparent to those skilled in the art that a coding apparatus includes a local decoder. The closed-loop pulse search method can obtain a better audio quality than the open-loop pulse search method because it selects the optimal pulses after the combining operation of the local decoder.

Figure 6:
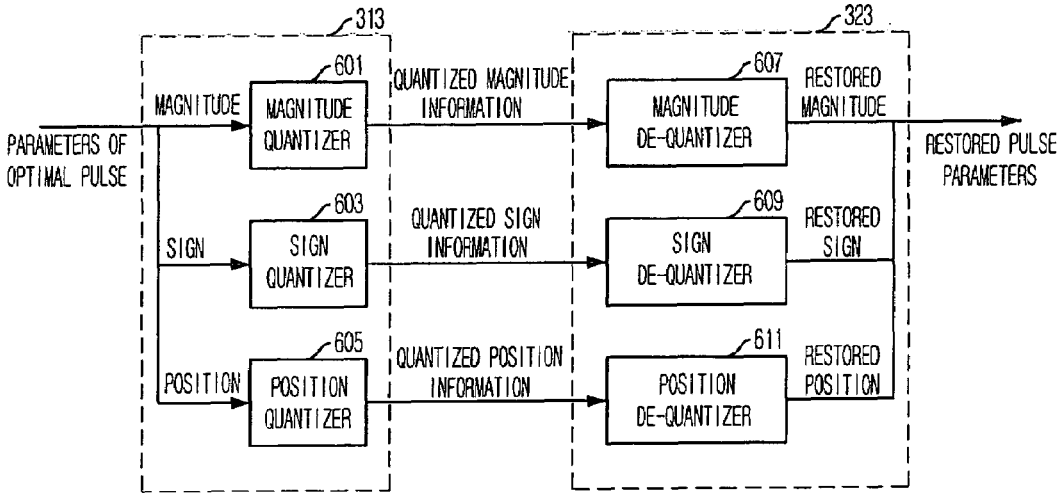
FIG. 6 is a detailed block diagram of a pulse quantizer/de-quantizer in FIG. 3 in accordance with an embodiment of the present invention.

The pulse quantizer 313 quantizes the pulse parameters from the pulse searcher 311 with a predetermined number of bits to output the resulting values to the residual signal decoding apparatus 320 (See FIG. 6).

Also, as illustrated in FIG. 3, the residual signal decoding apparatus 320 includes an LPC coefficient de-quantizer 321, a pulse de-quantizer 323, an LP synthesis filter 325, a pulse generator 329, a band combiner 327, and an inverse-transformer 331.

The LPC coefficient de-quantizer 321 de-quantizes the indices of the quantized LPC coefficients from the LPC coefficient quantizer 305 to output restored LPC coefficients.

The pulse de-quantizer 323 de-quantizes the quantized pulse parameters from the pulse quantizer 313 to output restored pulse parameters including the sign, position and magnitude information of the selected optimal pulse.

The pulse generator 329 generates pulses using the pulse sign, position and magnitude information outputted from the pulse de-quantizer 323. The pulses generated by the pulse generator 329 correspond to the restored LP residual transform coefficients for the respective bands.

The band combiner 327 concatenates the pulses from the pulse generator 450 (i.e., the LP residual transform coefficients for the respective bands) in all the bands to output restored LP residual transform coefficients.

The LP synthesis filter 325 is a filter that is made of the restored LPC coefficients from the LPC coefficients de-quantizer 321. The LP synthesis filter 325 performs an LP synthesis on the LP residual transform coefficients from the band combiner 327 to output restored transform coefficients. For example, the LP synthesis filter 325 calculates the restored transform coefficients X'(k) according to Equation 4 below.

$$X'(k) = R'(k) + \underset{i=1}{\overset{p}{Q}} a'_i X'(k-i) \qquad \text{Eq. (4)}$$

where R'(k) represents the restored LP residual transform coefficients and {a'j} represents the quantized LPC coefficients.

The inverse-transformer 331 inversely transforms the restored frequency-domain coefficients into time-domain residual signals. In an embodiment of the present invention, according to Equation 5 below, the inverse-transformer 331 performs an IDCT operation corresponding to the MDCT operation of the transformer 301 to output decoded residual signals x(n) However, the present invention is not limited to this. That is, it will be apparent to those skilled in the art that a variety of frequency-domain inverse-transform schemes may be used without departing form the sprit and scope of the present invention.

$$y(n) = \frac{4}{N}h(n)\sum_{k=0}^{N/2-1} X'(k)\cos\left\{\frac{2\pi}{N}\left(k+\frac{1}{2}\right)\left(n+\frac{N}{4}+\frac{1}{2}\right)\right\} \quad \text{Eq. (5)}$$

$$k = 0, 1, \ldots, \frac{N}{2}-1, n = 0, 1, \ldots, N-1$$

$$\hat{x}(n) = y'\left(n+\frac{N}{2}\right) + y(n), n = 0, 1, \ldots, \frac{N}{2}-1$$

where y(n) represents an inverse-transformed sample in a current block and y'(n) represents an inverse-transformed sample in the previous block.

The output signals (i.e., the residual signals) of the inverse-transformer 331 are input to, for example, the audio signal decoder 113.

Figure 4:
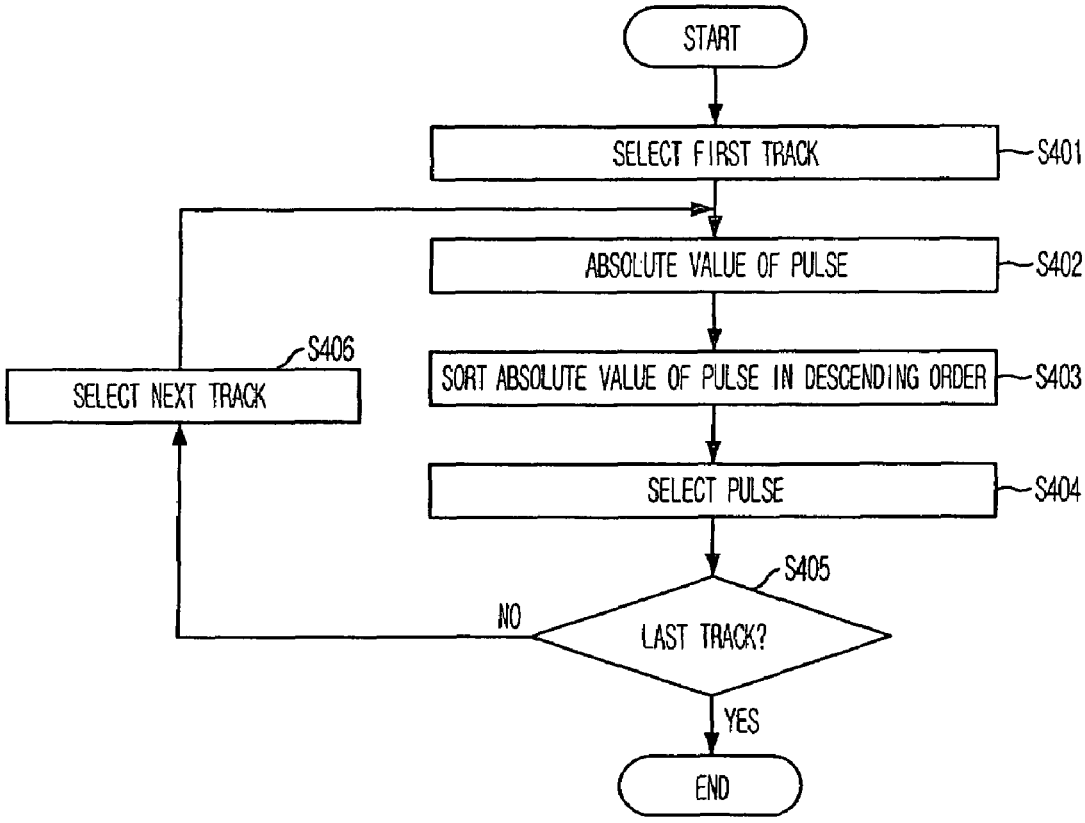
FIG. 4 is a flowchart illustrating an open-loop pulse search operation of a pulse searcher in accordance with an embodiment of the present invention.

FIG. 4 is a flowchart illustrating an open-loop pulse search operation of a pulse searcher in accordance with an embodiment of the present invention.

As described above, the number T of tracks per band, the number $2^m$ of pulses per track, and the number g of pulses to be searched in each track are determined considering the number $$\left(D, D = \underset{@T}{Q}2^m\right)$$

of LP residual transform coefficients in each band and the number $$\left(G, G = \underset{@T}{Q}g\right)$$

of pulses to be searched in each band.

Referring to FIG. 4, in step S401, the first track is selected.

In step S402, the absolute values of all the $2^m$ pulses in a selected track are calculated to obtain the magnitude information of the pulses.

In step S403, the calculated absolute values of the pulses are arranged in descending order. In step S404, the arranged absolute values are selected in descending order. When one pulse is searched per track as illustrated in Table 1, the largest pulse of each track is selected as an optimal pulse. When three pulses are selected from the first track as illustrated in Table 2, three pulses with first, second and third largest absolute values are selected as optima pulses. Likewise, pulses are selected from second to fifth track in descending order of an absolute value by the number (2, 2, 1, 1) of pulses to be searched.

In step S405, it is determined whether the selected track is the last track. When the selected track is not the last track, the next track is selected in step S407. Thereafter, steps S402 to S405 are performed to the next track. On the other hand, when the selected track is the last track, the open-loop pulse search operation is ended.

In this way, the pulse with the highest magnitude in each track is selected as an optimal pulse to calculate the per-track selected pulse combinations including a case where one pulse is selected per track, and the per-band selected pulse combinations, i.e., the sum of the per-track selected combinations in all the tracks, are calculated. The pulse searcher 311 outputs the pulse parameters of the respective optimal pulses, which are included in the per-track selected pulse combinations constituting the per-band selected pulse combinations, to the pulse quantizer 313.

Figure 5:
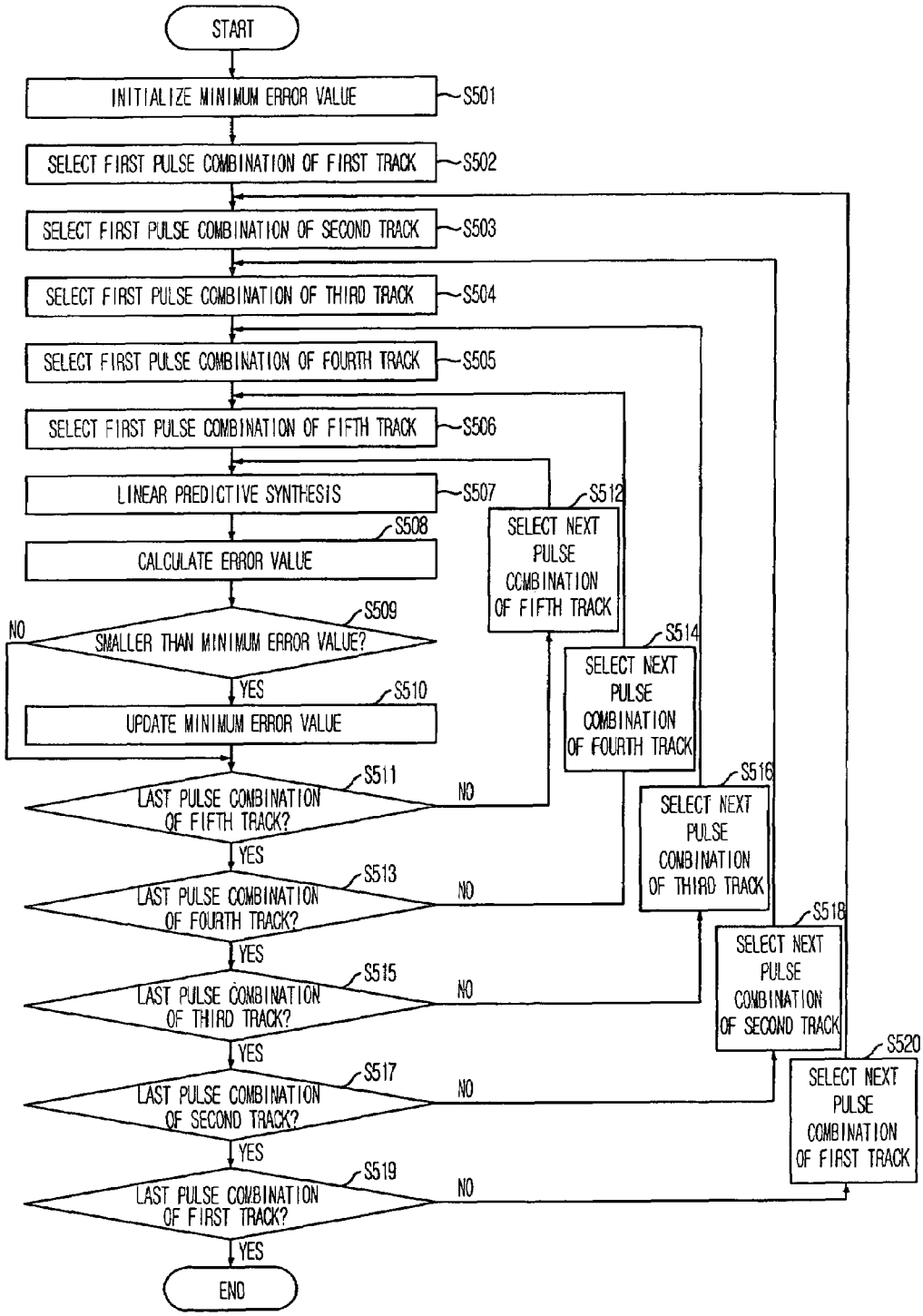
FIG. 5 is a flowchart illustrating a closed-loop pulse search operation of the pulse searcher in accordance with an embodiment of the present invention.

FIG. 5 is a flowchart illustrating a closed-loop pulse search operation of the pulse searcher in accordance with an embodiment of the present invention.

As described above, the number T of tracks per band, the number $2^m$ of pulses per track, and the number g of pulses to be searched in each track are determined considering the number $$\left(D, D = \underset{@T}{Q}2^m\right)$$

of LP residual transform coefficients in each band and the number $$\left(G, G = \underset{@T}{Q}g\right)$$

of pulses to be searched in each band.

Although an exemplary case where the number of tracks per band is 5 as illustrated in Tables 1 and 2 is described, the present invention is not limited to this.

Referring to FIG. 5, a predetermined minimum error value is initialized in step S501.

In step S502, the first pulse combination of the first track is selected. When one of eight pulses are searched in each track as in the embodiment of Table 1, ${}_8C_1$ (=8) pulse combinations are possible. A given one of the 8 pulse combinations is selected as the first pulse combination of the first track. On the other hand, when three pulses are selected from 16 pulses of the first track as in the embodiment of Table 2, the number of possible pulse combinations in the first track is ${}_{15}C_3$(=560). A given one of the 560 pulse combinations is selected as the first pulse combination of the first track.

In step S503, the second pulse combination of the second track is selected. When one of eight pulses is searched in each track as in the embodiment of Table 1, the first pulse combination of the second track is selected in the same manner as in step S502. On the other hand, when two pulses are selected from 8 pulses of the second track as in the embodiment of Table 2, the number of possible pulse combinations in the second track is ${}_8C_2$(=28). A given one of the 280 pulse combinations is selected as the first pulse combination of the second track.

Likewise, the first pulse combination of the third track, the first pulse combination of the fourth track and the first pulse combination of the fifth track are selected in steps S505, S505 and S506, respectively. That is, the per-track pulse combinations are selected through steps S502 to S506.

In step S507, the local decoder of the residual signal coding apparatus 300 performs an LP synthesis on the per-band pulse combinations, which are obtained by adding pulses of an entire track that has a value only at per-band pulse combinations of five pulses selected in each track but have a value of 0 at the other positions, to thereby generate per-band transform coefficients. In step S508, a difference, i.e., an error value, between the per-band transform coefficients from the local decoder and the original transform coefficients from the transformer 301 is calculated. In step S509, the calculated error value is compared with the currently-stored minimum error value. When the calculated error value is smaller the minimum error value, the minimum error value is updated in step S510.

In step S511, it is determined whether the pulse combination selected from the fifth track is the last pulse combination of the fifth track. When the pulse combination selected from the fifth track is not the last pulse combination of the fifth track, the next pulse combination of the fifth track is selected in step S512. Thereafter, steps S507 to S511 are repeated with respect to the next pulse combination of the fifth track.

On the other hand, when the pulse combination selected from the fifth track is the last pulse combination of the fifth track, it is determined in step S513 whether the pulse combination selected from the fourth track is the last pulse combination of the fourth track. When the pulse combination selected from the fourth track is not the last pulse combination of the fourth track, the next pulse combination of the fourth track is selected in step S514. Thereafter, steps S506 to S513 are repeated with respect to the next pulse combination of the fourth track.

On the other hand, when the pulse combination selected from the fourth track is the last pulse combination of the fourth track, it is determined in step S515 whether the pulse combination selected from the third track is the last pulse combination of the third track. When the pulse combination selected from the third track is not the last pulse combination of the third track, the next pulse combination of the third track is selected in step S516. Thereafter, steps S505 to S515 are repeated with respect to the next pulse combination of the third track.

On the other hand, when the pulse combination selected from the third track is the last pulse combination of the third track, it is determined in step S517 whether the pulse combination selected from the second track is the last pulse combination of the second track. When the pulse combination selected from the second track is not the last pulse combination of the second track, the next pulse combination of the second track is selected in step S518. Thereafter, steps S504 to S517 are repeated with respect to the next pulse combination of the second track.

On the other hand, when the pulse combination selected from the second track is the last pulse combination of the second track, it is determined in step S519 whether the pulse combination selected from the first track is the last pulse combination of the first track. When the pulse combination selected from the first track is not the last pulse combination of the second track, the next pulse combination of the first track is selected in step S520. Thereafter, steps S503 to S519 are repeated with respect to the next pulse combination of the first track.

Finally, the per-band pulse combination minimizing the error value is selected to calculate the per-band selected pulse combination. The per-track pulse combinations constituting the per-band selected pulse combination are the per-track selected pulse combinations. The pulse searcher 311 outputs the pulse parameters for the respective optimal pulses in the per-track selected pulse combinations constituting the per-band selected pulse combination to the pulse quantizer 313.

FIG. 6 is a detailed block diagram of the pulse quantizer/de-quantizer in FIG. 3 in accordance with an embodiment of the present invention.

A pulse quantizer 313 includes a magnitude quantizer 601, a sign quantizer 603, and a position quantizer 605.

The magnitude quantizer 601 quantizes the magnitude information of pulses selected from the respective tracks. At this point, since magnitude information of respective pulses does not appear in a track structure, a separate codebook is required. Accordingly, the separate codebook must be included in the residual signal coding/decoding apparatus. The sign quantizer 603 may quantize sign information of pulses with 1 bit depending on whether the sign of the pulse selected from each track is +1 or −1. The position quantizer 605 quantizes position information of the pulse selected from each track, with a predetermined number of bits that are determined depending on the number of positions per track. For example, when the number of positions per track is 8 as in the embodiment of Table 1, the pulse position information is quantized with 3 bits. When the number of positions in the first track is 16 as in the embodiment of Table 2, the pulse position information of the first track is quantized with 4 bits. When the number of positions in the second or third track is 8 as in the embodiment of Table 2, the pulse position information of the second or third track is quantized with 3 bits. When the number of positions in the fourth or fifth track is 4 as in the embodiment of Table 2, the pulse position information of the fourth or fifth track is quantized with 2 bits.

As described above, the track structure according to the embodiment of the present invention provides bit information necessary for pulse sign/position quantization. Therefore, the track structures according to the embodiment needs only a codebook that provides bit information necessary for pulse magnitude quantization. Accordingly, the memory usage required for storing a codebook in the residual signal coding/decoding apparatus can be saved and the amount of computation required for searching the codebook can be reduced.

Also, as illustrated in FIG. 6, a pulse de-quantizer 323 includes a magnitude de-quantizer 607, a sign de-quantizer 609, and a position de-quantizer 611.

The magnitude de-quantizer 607 de-quantizes magnitude information of a predetermined number of bits from the magnitude quantizer 601 to restore a pulse magnitude. The sign de-quantizer 609 de-quantizes sign information of a predetermined number of bits from the sign quantizer 603 to restore a pulse sign. The position de-quantizer 611 de-quantizes position information of a predetermined number of bits from the position quantizer 605 to restore a pulse position.

Figure 7:
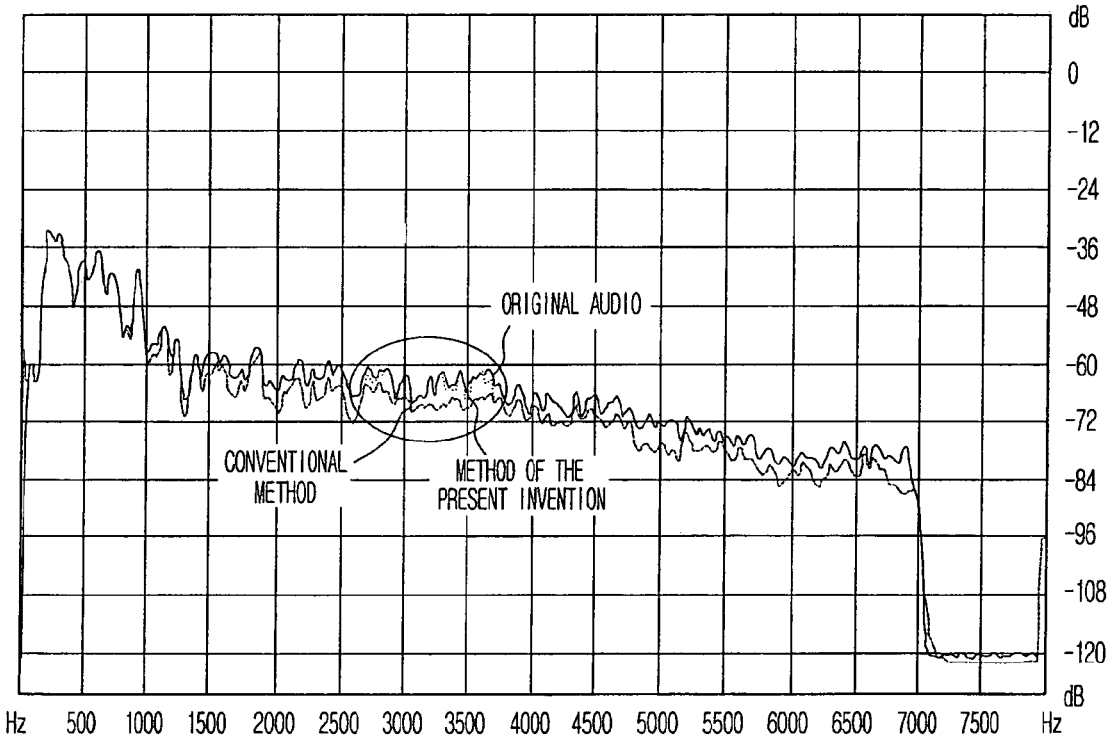
FIG. 7 is a graph comparing an original audio spectrum, an audio spectrum obtained by the conventional residual coding method using a transform coding scheme, and an audio spectrum obtained by the method according to the present invention.

FIG. 7 is a graph comparing an original audio spectrum, an audio spectrum obtained by the conventional residual signal coding method using a transform coding scheme, and an audio spectrum obtained by the method according to the present invention, which illustrates a case where an audio signal in the band of 2.7~3.7 KHz is coded with 40 bits and then the coded signal is decoded. For convenience in comparison, all the remaining bands are processed using the conventional method.

Referring to FIG. 7, a signal located at the highest position in a region circled is a spectrum of an original audio signal. A signal located at the middle position is a spectrum of an audio signal processed by the method of the present invention. A signal located at the lowest position is a spectrum of an audio signal processed by the conventional method. As can be seen from the graph of FIG. 7, the spectrum of the audio signal processed by the method of the present invention is more similar to the spectrum of the original audio signal than the spectrum of the signal processed by the conventional method.

The methods according to the embodiments of the present invention can be written as computer programs and can be implemented in general-purpose digital computers that execute the programs using a computer-readable recording medium. Examples of the computer-readable recording medium include magnetic storage media, such as ROM, floppy disks and hard disks, optical recording media, such as CD-ROMs and DVDs, and storage media such as carrier waves, e.g., transmission through the Internet.

As described above, the residual signal coding/decoding apparatus and method according the present invention employs a linear predictive coding model and a track structure in a transform coding scheme, thereby making it possible to enhance an audio quality, save a memory requirement, and reduce an amount of computational complexity.

While the present invention has been described with respect to the particular embodiments, it will be apparent to those skilled in the art that various changes and modifications may be made without departing from the scope of the invention as defined in the following claims.

What is claimed is:

1. A residual signal coding apparatus, comprising:

a receiver for inputting audio signals and outputting time-domain residual signals of the inputted audio signals;

a transformer for transforming the time-domain residual signals into a frequency domain to output transform coefficients;

a linear predictive coding (LPC) coefficient extractor for extracting LPC coefficients from the transform coefficients;

an LPC coefficient quantizer for quantizing the LPC coefficients to output quantized LPC coefficients and corresponding indices;

a linear prediction (LP) analysis filter including a filter made of the quantized LPC coefficients and performing an LP analysis on the transform coefficients to output LP residual transform coefficients;

a band splitter for splitting the LP residual transform coefficients into a predetermined number of bands to output the LP residual transform coefficients on a per-band basis;

a pulse searcher for searching the LP residual transform coefficients for the respective bands to select an optimal pulse and output parameters of the optimal pulse; and a pulse quantizer for quantizing the parameters of the optimal pulse, wherein the residual signal coding apparatus outputs quantized LPC coefficients and corresponding indices, and quantized pulse parameters of the inputted audio signals.

2. The residual signal coding apparatus as recited in claim 1, wherein the transformer outputs the transform coefficients by performing Modified Discrete Cosine Transform (MDCT) on the time-domain residual signals.

3. The residual signal coding apparatus as recited in claim 1, wherein the transformer outputs MDCT coefficients by performing the MDCT on the time-domain residual signals based on an equation expressed as:

$$X(k) = \sum_{n=1}^{N-1} x(n)h(n)\cos\left\{\frac{2\pi}{N}\left(k+\frac{1}{2}\right)\left(n+\frac{N}{4}+\frac{1}{2}\right)\right\}$$

$$k = 0, 1, \ldots, \frac{N}{2}-1, n = 0, 1, \ldots, N-1$$

where X(k) represents the MDCT coefficients; x(n) represents the time-domain residual signals; h(n) represents a window function; n represents time-domain sample indices; and N represents the size of an MDCT block.

4. The residual signal coding apparatus as recited in claim 1, wherein the LPC coefficient quantizer calculates the quantized LPC coefficients and the corresponding indices based on a vector quantization (VQ) scheme or a predictive split vector quantization (PSVQ) scheme.

5. The residual signal coding apparatus as recited in claim 1, wherein the LP analysis filter outputs the LP residual transform coefficients based on an equation expressed as:

$$R(k) = X(k) - \sum_{i=1}^{p} a_1' X(k-i)$$

where R(k) represents the LP residual transform coefficients; and $a'_i$ represents the quantized LPC coefficients.

6. The residual signal coding apparatus as recited in claim 1, wherein the pulse quantizer comprises:

a magnitude quantizer for quantizing pulse magnitude information out of the parameters of the optimal pulse with a predetermined number of bits using a predetermined codebook;

a sign quantizer for quantizing pulse sign information out of the parameters of the optimal pulse with a predetermined number of bits using a track structure of the pulse searcher; and a position quantizer for quantizing pulse position information out of the parameters of the optimal pulse with a predetermined number of bits using the track structure of the pulse searcher.

7. The residual signal coding apparatus as recited in claim 1, wherein the LPC coefficient extractor extracts and outputs the LPC coefficients minimizing a function value of an equation expressed as:

$$E = \sum_{k=0}^{N-1}\left\{X(k) - \sum_{i=1}^{p} a_i X(k-i)\right\}^2$$

where E is a function representing a squared prediction error between a current transform coefficient and predicted coefficient from the past p number of transform coefficients; $a_i$ represents the LPC coefficients; and p represents an LP order.

8. The residual signal coding apparatus as recited in claim 7, wherein the LPC coefficient extractor calculates the LPC coefficients based on a Levinson-Durbin algorithm.

9. The residual signal coding apparatus as recited in claim 1, wherein the pulse searcher divides the LP residual transform coefficients for the respective bands into a predetermined number of tracks and searches the LP residual transform coefficients on a per-track basis to select a predetermined number of optimal pulses.

10. The residual signal coding apparatus as recited in claim 9, wherein the pulse searcher performs:

a first step of initializing a predetermined minimum error value;

a second step of selecting one of per-track pulse combinations depending on the number of pulses to be searched in each track;

a third step of generating per-band pulse combinations by setting a pulse value to a given value only at the selected per-band pulse combination but to 0 at the remaining positions;

a fourth step of outputting per-band transform coefficients that is LP-combined based on the per-band pulse combinations;

a fifth step of calculating an error value that is a difference between the per-band transform coefficients outputted in the fourth step and the original transform coefficients outputted from the transformer;

a sixth step of selecting the pulse in the per-track pulse combinations constituting the per-band pulse combination as the optimal pulse, when the calculated error value is smaller than the minimum error value stored in the first step; and a seventh step of repeating the second to sixth steps with respect to the remaining per-track pulse combinations.

11. The residual signal coding apparatus as recited in claim 9, wherein the pulse searcher performs:

a first step of selecting one from a predetermined number of the tracks:

a second step of obtaining magnitude information on all pulses of the selected track;

a third step of selecting the optimal pulses in a descending order of the magnitudes of the obtained magnitude information according to the number of pulses to be searched from the selected track; and a fourth step of repeating the first to third steps with respect to the remaining tracks.

12. The residual signal coding apparatus as recited in claim 11, wherein the number of pulses to be searched from each track is 1.

13. A residual signal coding method, comprising the steps of:

a) receiving an audio signal and transforming time-domain residual signals of the received audio signal into a frequency domain to output transform coefficients;

b) extracting linear predictive coding (LPC) coefficients from the transform coefficients;

c) quantizing the LPC coefficients to output quantized LPC coefficients and corresponding indices;

d) performing, using a filter made of the quantized LPC coefficients, a linear prediction (LP) analysis on the transform coefficients to output LP residual transform coefficients;

e) splitting the LP residual transform coefficients into a predetermined number of bands to output the LP residual transform coefficients on a per-band basis;

f) searching the LP residual transform coefficients for the respective bands to select an optimal pulse and output parameters of the optimal pulse; and g) quantizing the parameters of the optimal pulse.

14. The residual signal coding method as recited in claim 13, wherein the quantized LPC coefficients and the corresponding indices are calculated in the step c) based on a vector quantization (VQ) scheme or a predictive split vector quantization (PSVQ) scheme.

15. The residual signal coding method as recited in claim 13, wherein the LP residual transform coefficients are outputted in the step d) based on an equation expressed as:

$$R(k) = X(k) - \sum_{i=1}^{p} a_1' X(k-i)$$

where R(k) represents the LP residual transform coefficients, and a, represents the quantized LPC coefficients.

16. The residual signal coding method as recited in claim 13, wherein the transform coefficients are outputted in the step a) by performing Modified Discrete Cosine Transform (MDCT) on the time-domain residual signals.

17. The residual signal coding method as recited in claim 16, wherein MDCT coefficients are outputted in the step a) by performing the MDCT on the time-domain residual signals according to the following equation $$X(k) = \sum_{n=0}^{N-1} x(n)h(n)\cos\left\{\frac{2\pi}{N}\left(k+\frac{1}{2}\right)\left(n+\frac{N}{4}+\frac{1}{2}\right)\right\}$$

$$k = 0, 1, \ldots, \frac{N}{2}-1, n = 0, 1, \ldots, N-1$$

where X(k) represents the MDCT coefficients; x(n) represents the time-domain residual signals; h(n) represents a window function; n represents time-domain sample indices; and N represents the size of an MDCT block.

18. The residual signal coding method as recited in claim 13, wherein the LPC coefficients minimizing a function value of an equation expressed as:

$$E = \sum_{k=0}^{N-1}\left\{X(k) - \sum_{i=1}^{p} a_i X(k-i)\right\}^2$$

is outputted in the step b), where E is a function representing a squared prediction error between a current transform coefficient and predicted coefficient from the past p number of previous transform coefficients, $a_i$ represents the LPC coefficients, and p represents an LP degree.

19. The residual signal coding method as recited in claim 18, wherein the LPC coefficients are calculated in the Step b) base don a Levinson-Durbin algorithm.

20. The residual signal coding method as recited in claim 13, wherein the LP residual transform coefficients for The respective bands are split into a predetermined number of tracks and the LP residual transform coefficients of each track are searched to select a predetermined number of optimal pulses in the step f).

21. The residual signal coding method as recited in claim 20, wherein the step f) includes the steps of:

f5) initializing a predetermined minimum error value;

f6) selecting one of per-track pulse combinations depending on the number of pulses to be searched in each track;

f7) generating per-band pulse combinations by setting a pulse value to a given value only at the selected per-band pulse combination but to 0 at the remaining positions;

f8) outputting per-band transform coefficients that are LP-combined based on the per-band pulse combinations;

f9) calculating an error value that is a difference between the per-band transform coefficients outputted in the fourth step and the original transform coefficients outputted from the transformer;

f10) selecting the pulse in the per-track pulse combinations constituting the per-band pulse combination as the optimal pulse, when the calculated error value is smaller than the minimum error value stored in the first step; and f11) repeating the second to sixth steps with respect to the remaining per-track pulse combinations.

22. The residual signal coding method as recited in claim 20, wherein the step f) includes the steps of:

f1) selecting one from a predetermined number of the tracks;

f2) obtaining magnitude information on all pulses of the selected track;

f3) selecting The optimal pulses in descending order of the magnitudes of the obtained magnitude information according to the number of pulses to be searched from the selected track; and f4) repeating the first to third steps with respect to the remaining tracks.

23. The residual signal coding method as recited in claim 22, wherein the number of pulses to be searched from each track is 1.

24. A residual signal decoding apparatus comprising:

a linear predictive coding (LPC) de-quantizer receiving quantized LPC coefficients of an audio signal and de-quantizing indices of the received quantized LPC coefficients to output restored LPC coefficients;

a pulse de-quantizer receiving quantized pulse parameters of the audio signal and do-quantizing the received quantized Pulse parameters to output restored pulse parameters;

a pulse generator for generating pulses from the restored pulse parameters to output restored linear prediction (LP) residual transform coefficients for respective bands;

a band combiner for concatenating the restored LP residual transform coefficients for the respective bands with respect to all the bands to output restored LPC residual transform coefficients;

an LP synthesis filter including a filter made of the restored LPC coefficients and performing an LP synthesis on the restored LP residual transform coefficients to output restored transform coefficients; and an inverse-transformer for inversely transforming the restored frequency-domain transform coefficients into a time domain to decode residual signals, wherein the decoded residual signals are inputted to an audio signal decoder to output decoded audio signals.

25. The residual signal decoding apparatus as recited in claim 24, wherein the pulse de-quantizer includes:

a magnitude de-quantizer for de-quantizing magnitude information with a predetermined number of bits among quantized pulse parameters to restore a pulse magnitude;

a sign de-quantizer for de-quantizing sign information with a predetermined number of bits among the quantized pulse parameters to restore a pulse sign; and a position de-quantizer for de-quantizing position information with a predetermined number of bits among the quantized pulse parameters to restore a pulse position.

26. A residual signal decoding method, comprising the steps of:

a) receiving quantized linear predictive coding (LPC) coefficients of an audio signal and de-quantizing the indices of the quantized linear predictive coding (LPC) coefficients to output restored LPC coefficients;

b) receiving quantized pulse parameters of the audio signal and de-quantizing the quantized pulse parameters to output restored pulse parameters;

c) generating pulses from the restored pulse parameters to output restored linear prediction (LP) residual transform coefficients for respective bands;

d) adding the restored LP residual transform coefficients for the respective bands with respect to all the bands to output restored LPC residual transform coefficients;

e) performing, using a filter made of the restored LPC coefficients, an LP synthesis on the restored LP residual transform coefficients to output restored transform coefficients; and f) inversely transforming the restored frequency-domain transform coefficients into a time domain to decode residual signals, g) providing the decoded residual signals to an audio signal decoder and outputting a decoded audio signal.

* * * * *